US006019649A

United States Patent [19]

Friesen et al.

[11] Patent Number: 6,019,649

[45] Date of Patent: Feb. 1, 2000

[54] ADJUSTABLE PROPELLER SYSTEM

[76] Inventors: John Friesen, 827 Pt. Pelee Drive; Jake Friesen, 789 Pt. Pelee Drive, both of Leamington, Ontario, Canada, N8H 3V4; Henry Friesen, 43 Bruce Avenue, Leamington, Ontario, Canada, N8H 4C4

[21] Appl. No.: 08/851,620

[22] Filed: May 6, 1997

Related U.S. Application Data

[60] Provisional application No. 60/016,963, May 6, 1996.

[51] Int. Cl.[7] ..... B63H 5/125

[52] U.S. Cl. ..... 440/53; 440/61; 440/57

[58] Field of Search ..... 440/53, 55, 56, 440/57, 58, 59, 61

[56] References Cited

U.S. PATENT DOCUMENTS

| | | | |
|---|---|---|---|
| 1,225,252 | 5/1917 | Johnston . | |
| 1,356,231 | 10/1920 | Standeford . | |
| 1,693,590 | 12/1928 | Borgman . | |
| 1,831,739 | 11/1931 | Decker . | |
| 2,050,497 | 8/1936 | Collum . | |
| 2,114,633 | 4/1938 | Hedges . | |
| 2,737,920 | 3/1956 | Heath . | |
| 2,752,875 | 7/1956 | Hills . | |
| 2,755,766 | 7/1956 | Wanzer . | |
| 2,949,791 | 8/1960 | Cattaneo et al. . | |
| 3,006,311 | 10/1961 | Hansson et al. . | |
| 3,605,678 | 9/1971 | Shimanckas . | |
| 3,841,257 | 10/1974 | Strang . | |
| 4,089,290 | 5/1978 | Miles et al. | 440/61 |
| 4,354,848 | 10/1982 | Hall et al. | 440/61 |
| 4,781,631 | 11/1988 | Uchida et al. . | |
| 4,846,741 | 7/1989 | Betsinger . | |
| 4,872,857 | 10/1989 | Newman et al. | 440/61 |
| 4,981,452 | 1/1991 | Grinde | 440/57 |
| 5,647,780 | 7/1997 | Hosoi | 440/57 |

*Primary Examiner*—Stephen Avila
*Attorney, Agent, or Firm*—Howard & Howard

[57] ABSTRACT

An adjustable propeller system includes an outboard drive portion having a propeller. At least one linearly extendable and retractable trim arm is mounted between an outboard plate and the propeller to adjust the trim angle between the outboard plate and the propeller. An upper arm and a lower arm are each pivotally mounted to a transom mounting plate and pivotally mounted to the outboard mounting plate. The upper and lower arm are linearly extendable and retractable to adjust the depth of the outboard drive portion.

21 Claims, 5 Drawing Sheets

ADJUSTABLE PROPELLER SYSTEM

This patent application claims priority to U.S. Provisional Application Ser. No. 60/016,963 filed May 6, 1996.

BACKGROUND OF THE INVENTION

The present invention relates to an adjustable propeller system for an inboard/outboard motor in which the depth of the propeller and the angle of the propeller relative to the surface of the water are independently adjustable.

In order to maximize power during startup, the propeller of a power boat is preferably immersed more deeply in the water. On the other hand, during high speed operation, the propeller is preferably near the surface of the water. Commercially available connections for inboard/outboard motors have not provided this adjustability. As a result, current inboard/outboard motors are not able to maximize both power during start-up and during high-speed operation.

Due to the lack of adjustability, the current boat operators have gone to extreme measures to provide adjustment. During a turn, current power boats have opened a ballast tank in the front of the boat to fill it with water while simultaneously adjusting the trim angle of the propeller inward, i.e., pivoting the propeller towards the boat. This has allowed some depth adjustment. After the turn, it is necessary to re-adjust the trim angle and empty the water from the ballast tank. This complex operation would not be necessary if the depth of the propeller could be adjusted.

Some prior devices have provided the ability to adjust the depth of the outboard drive portion of an inboard/outboard motor. The prior depth adjustment devices have not been suitable for high-power applications because of insufficiently durable connections between the transom and the outboard drive portion and because the extended drive shaft portion between the transom and the outboard drive portion has not been supported sufficiently to withstand the high power.

SUMMARY OF THE INVENTION

The present invention provides an adjustable propeller system for an inboard/outboard motor in which the depth of the propeller is adjustable independently of the trim angle. The propeller system is also sufficiently durable to be suitable in high-power applications. The propeller system generally comprises a propeller mounted on an outboard drive portion. The outboard drive portion includes at least one trim arm which is linearly retractable and extendable to adjust the angle of the propeller relative to the outboard drive portion.

A height adjustment assembly is mounted between a transom of the boat and the outboard drive portion. The height adjustment assembly includes at least one upper arm pivotally mounted at the transom and pivotally mounted at the outboard drive portion. The height adjustment assembly further preferably includes at least one lower arm pivotally mounted at the transom and pivotally mounted at the outboard drive portion. Each of the upper and lower arms is linearly extendable and retractable.

An electronic controller receives a first signal from a first input device for controlling the trim angle and a second signal from a second input device for controlling the depth. The controller controls the extension and retraction of the trim arm and the upper and lower arms. In this manner, the depth of the propeller and the trim angle are adjustable independently. As a result, the depth of the propeller and angle of the propeller relative to the surface of the water can also be set independently. Preferably the electronic controller operates to maintain the angle of the propeller relative to the surface of the water when the driver adjusts the depth of the outboard drive portion using the second input device. The electronic controller preferably automatically extends and retracts the trim arm to maintain a constant angle of the propeller relative to the surface of the water. The driver can override this automatic compensation by activating both the first input device and second input device simultaneously.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

Figure 1:
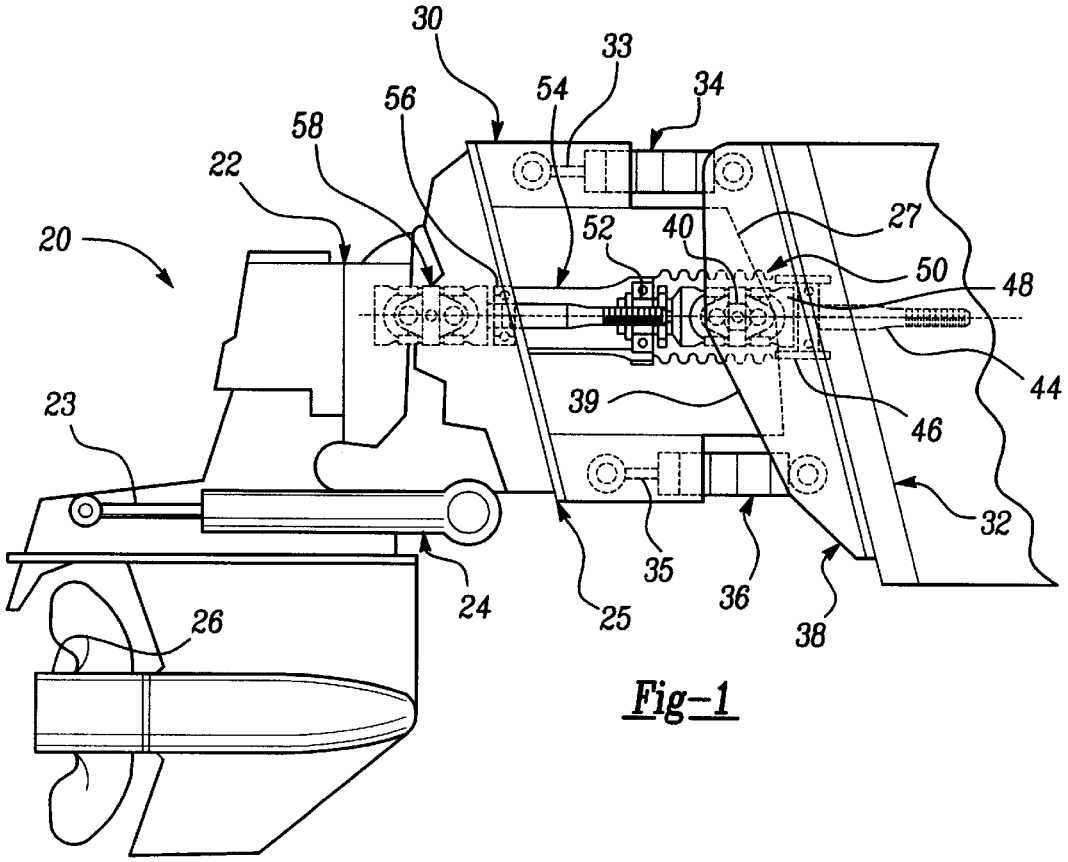
FIG. 1 is a side view, partially broken away, of the adjustable propeller system of the present invention.

An adjustable propeller system 20 for an inboard/outboard boat motor is shown in FIG. 1. The outboard drive portion 22 includes a pair of trim arms 23 (one shown) and trim cylinders 24 (one shown) between an outboard mounting plate 25 and a propeller 26. The trim cylinders 24 selectively extend and retract the trim arms 23 to adjust the angle of the propeller 26 relative to the outboard mounting plate 25. Some commercially available outboard drive portions 22 provide a trim cylinder 24 for adjusting the trim angle of the propeller 26 relative to the surface of the water. The term "trim angle" will be used to describe the angle of the propeller 26 relative to the outboard mounting plate 25, rather than the angle of the propeller 26 relative to the surface of the water. The outboard mounting plate 25 includes a pair of laterally-spaced, forwardly extending support plates 27 (one shown).

A height adjustment assembly 30 is mounted between the transom 32 and outboard mounting plate 25. A pair of upper arms 33 and upper cylinders 34 and a pair of lower arms 35 and lower cylinders 36 extend between a transom mounting plate 38 secured to the transom 32 and the outboard mounting plate 25 secured to the outboard drive portion 22. The transom mounting plate 38 includes a pair of rearwardly extending support plates 39 (one shown) adjacent the support plates 27 of the outboard mounting plate 25. A pair of pivot pins 40 (one shown) hingeably connect the support plates 27 to the support plates 39.

The outboard drive portion 22 and propeller 26 are driven by an inboard engine (not shown) by the shaft 44 which is supported by a bearing assembly 46 at the transom 32. The shaft 44 extends from the bearing assembly 46 to a double U-joint 48, which is protected by a rubber boot 50. The shaft 44 is further supported by a bearing assembly 52 mounted in a cylindrical sleeve 54 secured to the outboard mounting plate 25 and a bearing assembly 56 mounted in the outboard mounting plate 25. Rearwardly of the mounting plate 25, the shaft 44 extends to a second double U-joint 58 and into the outboard drive portion 22.

Figure 2:
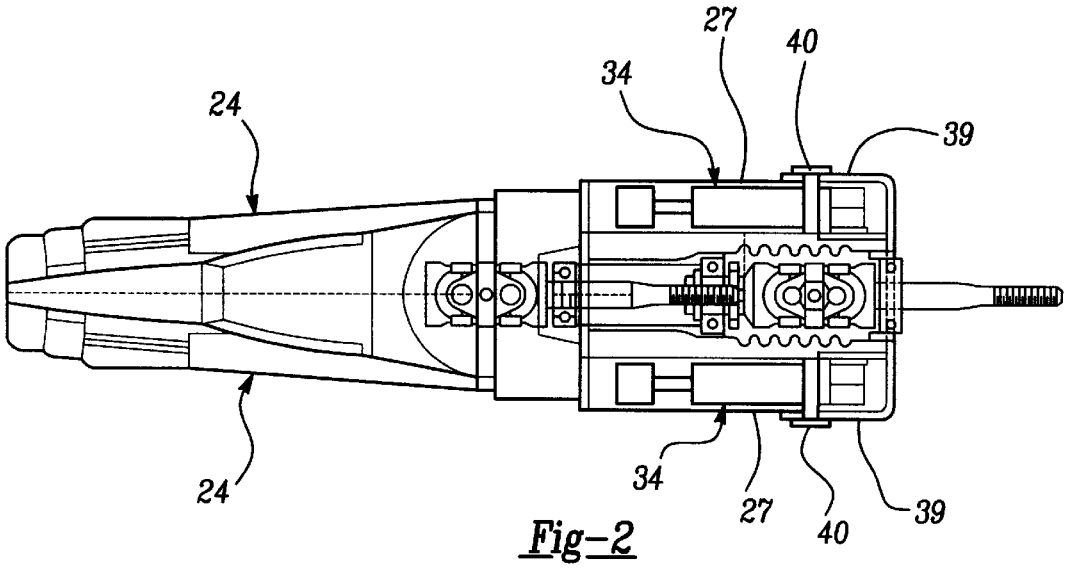
FIG. 2 is a top view of the adjustable propeller system of FIG. 1.
Figure 3:
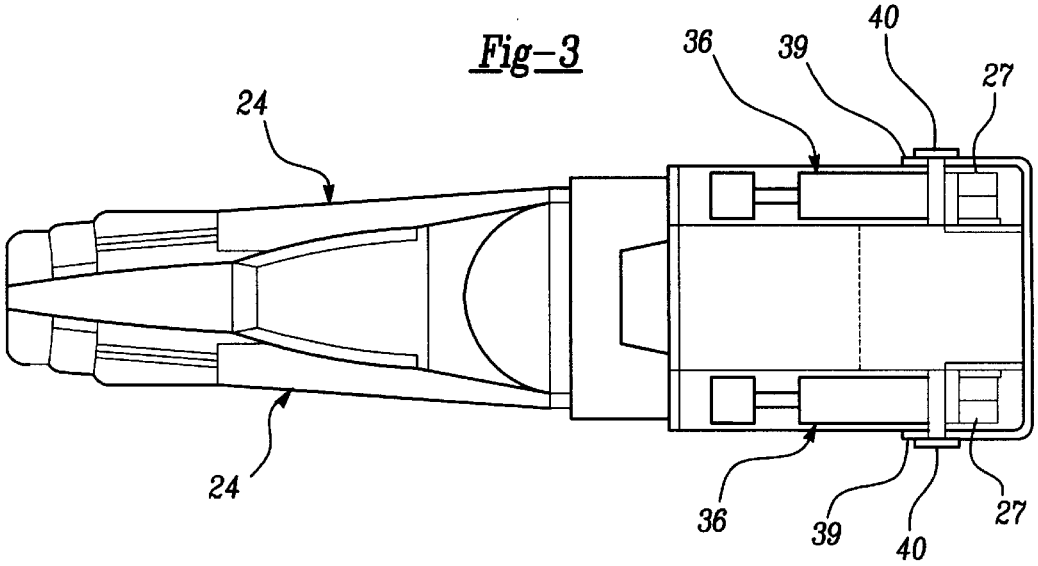
FIG. 3 is a bottom view of the adjustable propeller system of FIG. 1.

As can be seen in FIGS. 2 and 3, the trim cylinders 24 are mounted on opposite sides of the outboard drive portion 22. The two upper cylinders 34 are mounted on opposite sides of the shaft 44, as are the two lower cylinders 36. The two upper cylinders 34 extend and retract the upper arms 33 to adjust the depth of the outboard drive portion. The pivot pins 40 hingeably connect the support plates 27 to the support plates 39 in one degree of freedom and provide structural support to the height adjustment assembly 30.

Figure 4:
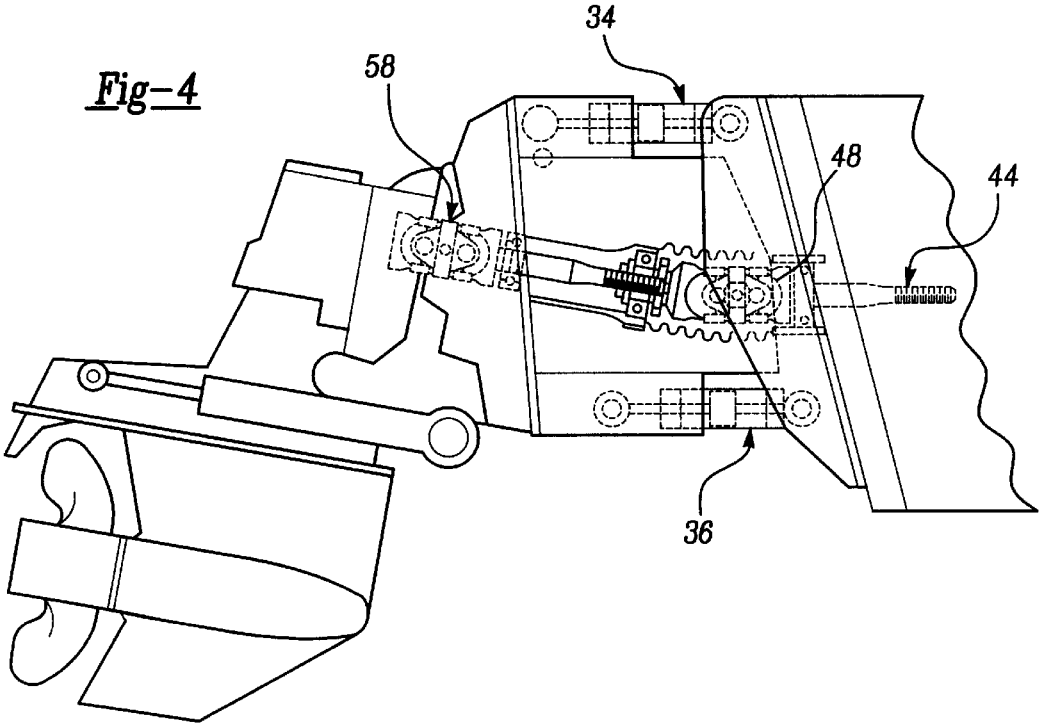
FIG. 4 is a side view, partially broken away, of the height adjustment assembly of the adjustable propeller system of FIG. 1 in a mid-position.

As can be seen in FIG. 4, the upper cylinders 34 and lower cylinders 36 extend and retract the upper arms 33 and lower arms 35, respectively, in a complementary fashion to adjust the depth of the outboard drive portion 22. During adjustment of the depth of the outboard drive portion 22, the shaft 44 pivots at the double U-joint 48.

Figure 5:
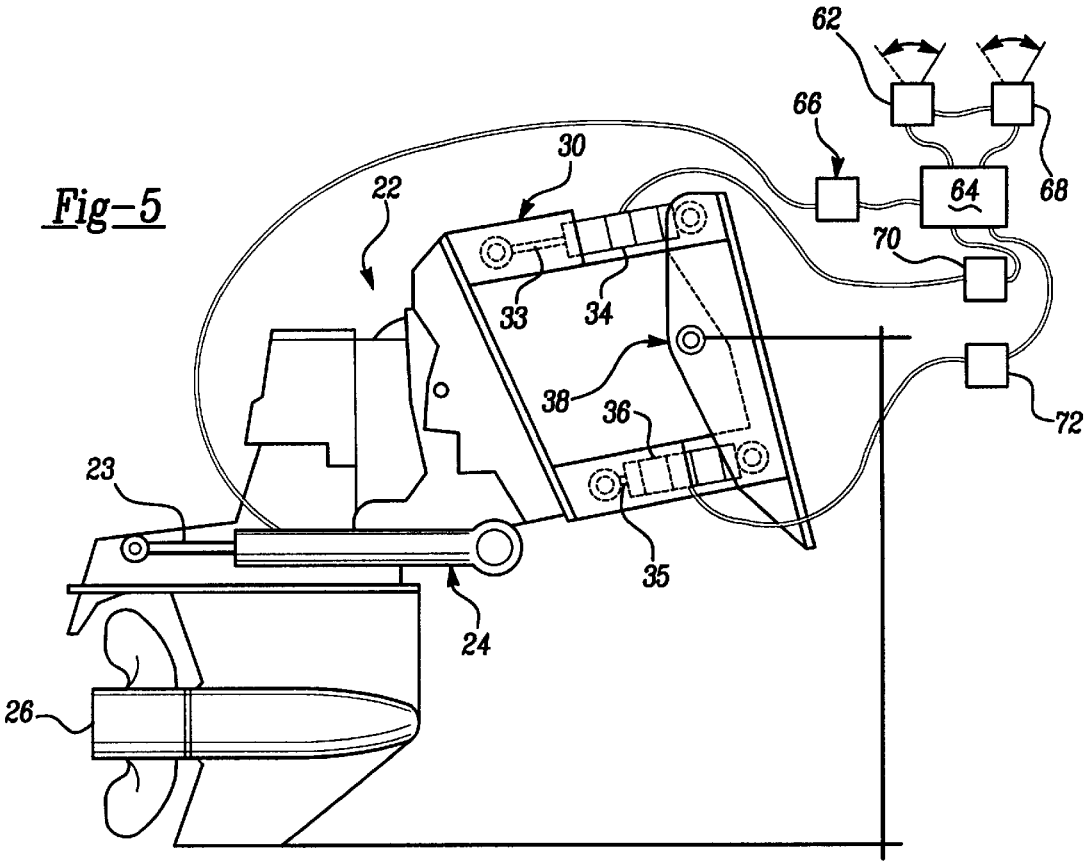
FIG. 5 is a schematic of the controls for the adjustable propeller system of FIG. 1.

As can be seen in FIG. 5, the extension and retraction of the trim arms 23 by the trim cylinders 24 is controlled by a first input device, such as a trim lever 62, which would be controlled by the driver of the boat. The trim lever 62 is connected to an electronic controller 64 which controls a hydraulic pump 66 operating the trim cylinders 24 to extend and retract the trim arms 23 to increase and decrease the trim angle of the propeller 26. This type of control is currently available on commercially available outboard drive portions 22 with adjustable trim angles.

A second input device, such as a depth lever 68, is preferably also connected to the electronic controller 64 to operate an upper hydraulic pump 70 and lower hydraulic pump 72. Also, it may be preferable to replace the two pumps 70 and 72 with a single pump. It should be apparent that the electronic controller 64 would insure that the hydraulic pumps 70 and 72 operate in a complementary fashion, i.e., the upper cylinders 34 would extend while the lower cylinders 36 are retracting and vice versa. In this manner, the depth of the outboard drive portion 22 and propeller 26 is adjustable. By controlling the trim cylinders 24 and upper and lower cylinders 36, 34 independently, the depth of the propeller 26 and the angle of the propeller 26 relative to the surface of the water can also be set independently.

Figure 6:
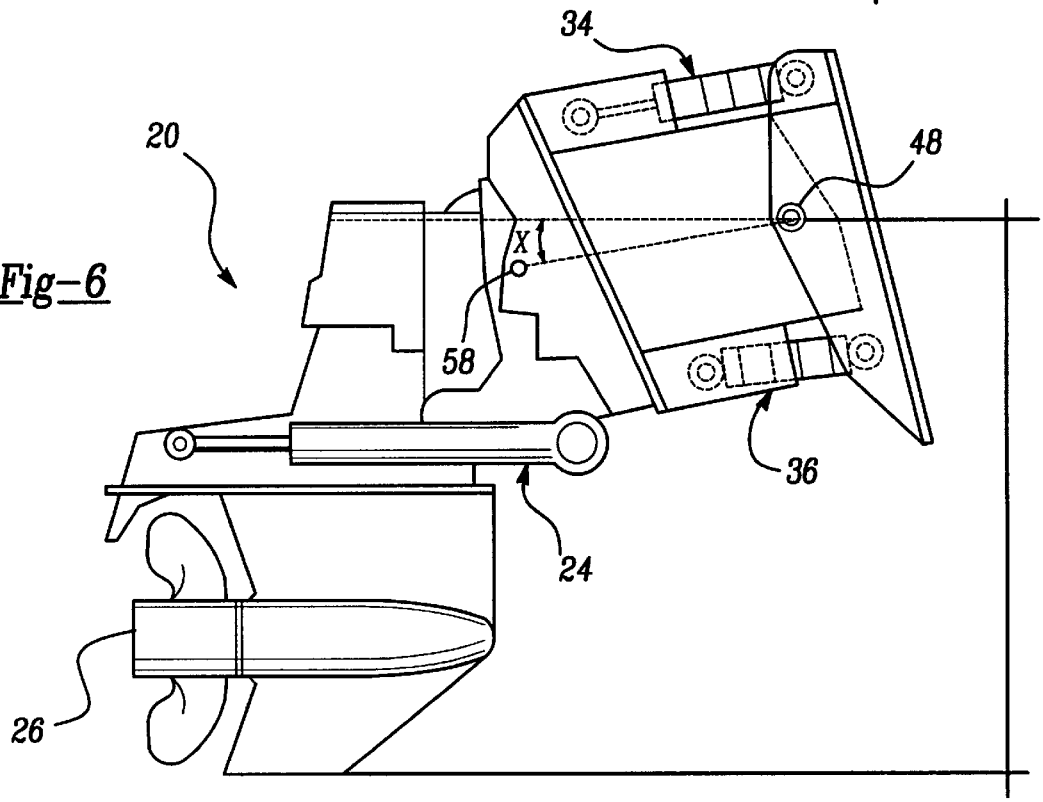
FIG. 6 is the adjustable propeller system of FIG. 1 with the outboard drive portion lowered and the trim angle increased to maintain the angle of the propeller relative to the transom mounting plate and surface of the water.

FIG. 6 shows the adjustable propeller system 20 with the upper cylinders 34 extended and the lower cylinders 36 retracted in order to provide a 10 degree downward deflection of the outboard drive portion 22. The 10 degree angle of deflection is measured between the two double U-joints 48 and 58 relative to the horizontal and is indicated as "X" in FIG. 6. Also in FIG. 6, the trim angle of the outboard drive portion 22 has been adjusted plus-10 degrees by extending the trim cylinder 24. As a result, the propeller 26 is extended to its maximum depth, while adjustment of the trim angle compensates for any change in angle between the outboard mounting plate 25 and transom mounting plate 38 in order to maintain a desired angle of the propeller 26 relative to the transom mounting plate 38. As a result, the propeller 26 depth can be increased while maintaining the propeller 26 at a constant angle relative to the surface of the water.

Figure 7:
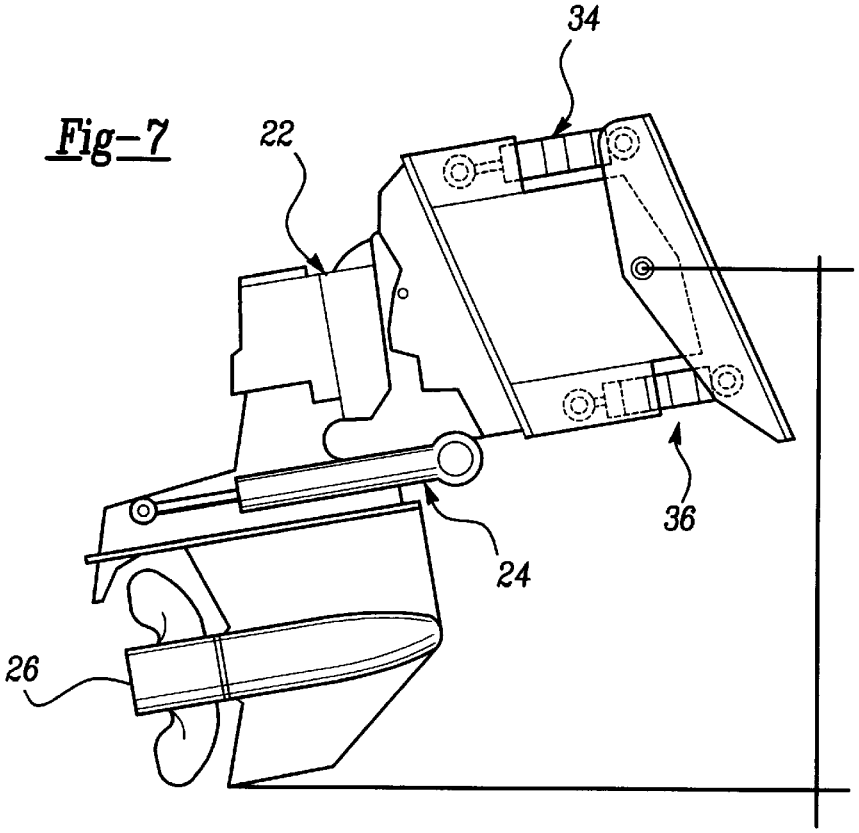
FIG. 7 is the adjustable propeller system of FIG. 6 with a trim angle of zero to provide a −10° deflection of the propeller relative to the surface of the water.

In FIG. 7, the upper cylinders 34 are extended, while the lower cylinders 36 are retracted, again giving a downward deflection of 10 degrees for the outboard drive portion 22. In this figure, however, the trim cylinder 24 is in a mid-position to achieve a trim angle of 0 degrees. The net result is to increase the depth of the propeller 26 while the angle of the propeller 26 relative to the transom mounting plate 38 has been changed negative 10 degrees. Therefore, the angle of the propeller 26 relative to the surface of the water is also negative 10 degrees.

Figure 8:
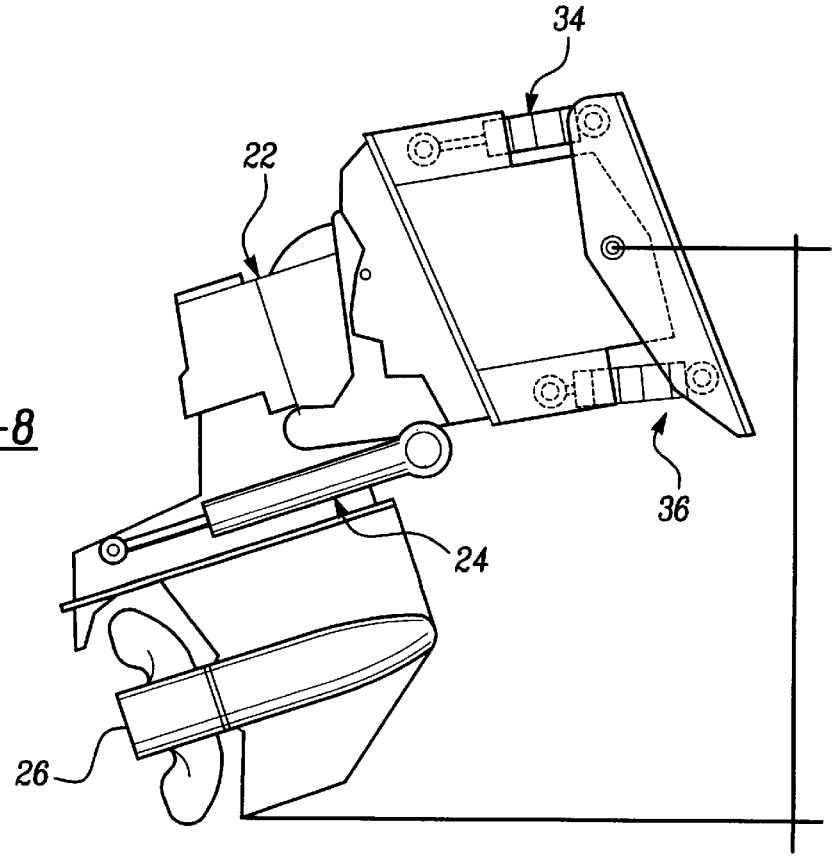
FIG. 8 is the adjustable propeller system of FIG. 7 with the trim angle fully retracted to provide a −20° deflection of the propeller relative to the surface of the water.

In FIG. 8, the upper cylinders 34 are extended while the lower cylinders 36 are retracted, again increasing the depth of the outboard drive portion 22. In this figure, however, the trim cylinder 24 is fully retracted, thereby subtracting another 10 degrees from the angle of the propeller 26 relative to the transom mounting plate 38 and relative to the surface of the water.

Figure 9:
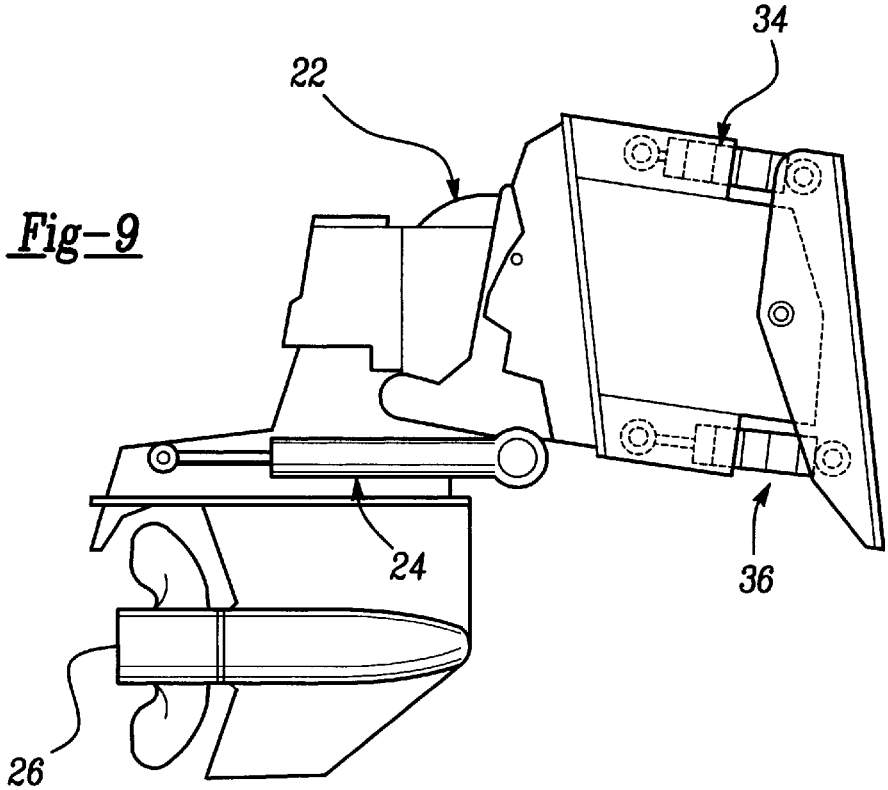
FIG. 9 is the adjustable propeller system of FIG. 1 with the outboard drive portion in a raised position and the trim angle retracted to maintain a constant angle between the propeller and the surface of the water.

In FIG. 9, the upper cylinders 34 are retracted while the lower cylinders 36 are extended, thereby raising the outboard drive portion 22 10 degrees. In this figure, the trim cylinder 24 is retracted, to provide a negative 10 degree trim angle. The net result in FIG. 9 is that the outboard drive portion 22 is fully raised while maintaining the propeller 26 in a horizontal position relative to the surface of the water. This position would be used during high speed operation.

Figure 10:
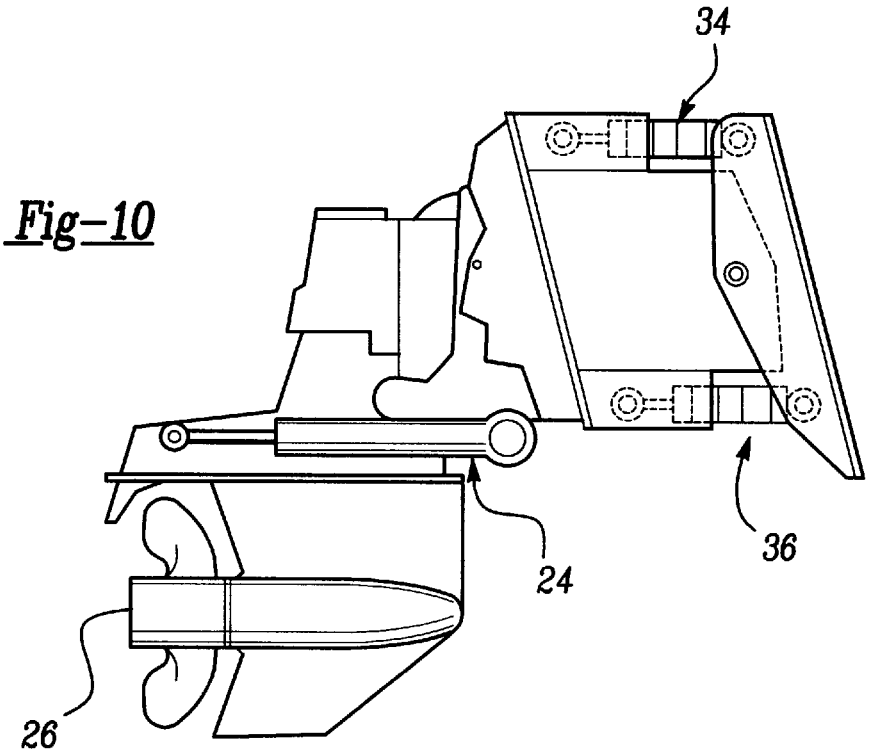
FIG. 10 is the adjustable propeller system of FIG. 1 with the outboard drive portion in a mid-level depth and the propeller adjusted to a 0° deflection.

In FIG. 10, the upper cylinders 34 and lower cylinders 36 are at a mid-position, as is the trim cylinder 24. This places the outboard drive portion 22 at a medium depth with the propeller 26 at a horizontal orientation relative to the surface of the water.

Note that between the extremes of FIGS. 8 and 9, the depth of the propeller changes from 36.6 to 27.2 inches, a sufficient amount of adjustment such that the system achieves desired depth control.

The adjustable propeller system 20 of the present invention permits independent adjustment of the depth of the outboard drive portion 22 and the trim angle of the propeller 26. Therefore, the propeller 26 can be operated at any depth and angle relative to the surface of the water. The depth and trim angle can be controlled completely independently utilizing the trim lever 62 and depth lever 68. Preferably the electronic controller 64 operates to maintain the angle of the propeller 26 relative to the surface of the water when the driver adjusts the depth of the outboard drive portion 22 utilizing the depth lever 68. The electronic controller 64 preferably automatically extends and retracts the trim cylinder 24 to maintain a constant angle of the propeller relative to the surface of the water. The driver can override this automatic compensation by activating both the trim lever 62 and depth lever 68 simultaneously.

The adjustable propeller system 20 of the present invention is more suitable for high power applications than prior devices. The hinged connection between the mounting plates 38, 25 increases the strength and stability of the height adjustment assembly 30. Further, the bearing assembly 52 between the transom 32 and the outboard drive portion 22 increases the support and stability of the shaft in its various orientations.

It should be understood that the trim arm 23 and trim cylinders 24, upper and lower arms 33, 35 and upper and lower cylinders 34, 36 could alternatively be replaced with other known devices for extending and retracting, such as a gear device.

In accordance with the provisions of the patent statutes, the present invention has been described in what is considered to represent a preferred embodiment. However, it should be noted that the invention can be practiced otherwise than as specifically illustrated and described without departing from its spirit or scope.

What is claimed is:

1. An adjustable propeller system comprising:

a propeller;

an outboard drive portion;

at least one trim arm mounted between said propeller and said outboard drive portion, said at least one trim arm being selectively extendable and retractable to adjust a trim angle of said propeller relative to said outboard drive portion;

at least one depth arm having a first end pivotally mounted to a transom mounting plate and a second end pivotally mounted to said outboard drive portion, said at least one depth arm being selectively extendable and retractable to adjust the depth of said outboard drive portion.

2. The adjustable propeller system of claim 1 further including a rotating shaft extending through a bearing in said transom mounting plate to said outboard drive portion to drive said propeller.

3. The adjustable propeller system of claim 2 wherein said outboard drive portion includes an outboard mounting plate, said trim arm adjusting the angle between said propeller and said outboard mounting plate, said shaft supported by a bearing mounted in said outboard mounting plate.

4. The adjustable propeller system of claim 3 further including a cylindrical sleeve extending from said outboard mounting plate toward said transom mounting plate, said shaft supported by a bearing at a forward end of said cylindrical sleeve.

5. The adjustable propeller system of claim 3 wherein said shaft includes a universal joint between said transom mounting plate and said outboard drive portion.

6. The adjustable propeller system of claim 3 wherein said shaft includes a universal joint between said outboard mounting plate and said propeller.

7. The adjustable propeller system of claim 3 wherein said at least one depth arm includes at least one upper arm selectively extendable and retractable and at least one lower arm selectively extendable and retractable in a manner complementary to said at least one upper arm.

8. The adjustable propeller system of claim 7 wherein said at least one upper arm and said at least one lower arm are extended and retracted by cylinders.

9. The adjustable propeller system of claim 1 wherein said at least one trim arm is extended and retracted by a cylinder.

10. The adjustable propeller system of claim 1 further including:

a controller controlling the extension and retraction of said at least one trim arm and said at least one depth arm;

a first input device sending a first signal to said controller, said controller extending and retracting said at least one trim arm based upon said first signal.

11. The adjustable propeller system of claim 10 further including:

a second input device sending a second signal to said controller, said controller extending and retracting said at least one depth arm based upon said second signal.

12. The adjustable propeller system of claim 10 further including:

a second input device sending a second signal to said controller;

said controller extending and retracting said at least one trim arm, said at least one depth arm based upon said second signal such that said trim arm changes said trim angle to maintain a constant angle of said propeller relative to said mounting plate when said at least one depth arm changes the depth of said outboard drive portion.

13. The adjustable propeller system of claim 2 wherein said outboard drive portion includes an outboard mounting plate, said outboard mounting plate hingeably connected to said transom mounting plate.

14. The adjustable propeller system of claim 13 wherein said outboard mounting plate includes at least one first support plate extending forwardly toward said transom mounting plate, said transom mounting plate including at least one second support plate extending rearwardly toward said outboard mounting plate, at least one pivot pin inserted through at least one first support plate and said at least one second support plate.

15. An adjustable propeller system comprising:

an outboard drive portion including a propeller;

means for adjusting the depth of said propeller, said means for adjusting the depth of said propeller disposed between a transom mounting plate and said outboard drive portion, said means for adjusting said depth of said propeller changing an angle of said outboard drive portion relative to said transom mounting plate when adjusting said depth; and means for adjusting a trim angle of said propeller independently of adjusting said depth of said propeller, said means for adjusting trim angle disposed between said outboard drive portion and said propeller, said means for adjusting trim angle compensating for the change in said angle of said outboard drive portion in order to maintain a relatively constant propeller angle relative to said transom mounting plate.

16. The adjustable propeller system of claim 15 wherein said means for adjusting the depth of said propeller adjusts the depth of said outboard drive portion.

17. The adjustable propeller system of claim 15 wherein said means for adjusting the trim angle of said propeller adjusts an angle of said propeller relative to said outboard drive portion.

18. The adjustable propeller system of claim 15 wherein said outboard drive portion includes an outboard mounting plate, said outboard mounting plate hingeably connected to said transom mounting plate.

19. The adjustable propeller system of claim 18 wherein said outboard mounting plate includes at least one first support plate extending forwardly toward said transom mounting plate, said transom mounting plate including at least one second support plate extending rearwardly toward said outboard mounting plate, at least one pivot pin inserted through at least one first support plate and said at least one second support plate.

20. An adjustable propeller system comprising:

a transom mounting plate;

an outboard drive portion including a propeller and an outboard mounting plate having a bearing;

at least one trim arm mounted between said propeller and said outboard drive portion, said at least one trim arm being selectively extendable and retractable to adjust a trim angle of said propeller relative to said outboard drive portion;

at least one upper depth arm having a first end pivotally mounted to said transom mounting plate and a second end pivotally mounted to said outboard drive portion, said at least one upper depth arm being selectively extendable and retractable to adjust the depth of said outboard drive portion;

at least one lower depth arm having a first end pivotally mounted to said transom mounting plate and a second end pivotally mounted to said outboard drive portion, said at least one lower depth arm selectively extendable and retractable in a manner complementary to said at least one upper depth arm;

a rotating shaft extending through a bearing in said transom mounting plate to said outboard drive portion to drive said propeller, said shaft supported by said bearing mounted in said outboard mounting plate.

21. An adjustable propeller system comprising:

a propeller;

a transom mounting plate;

an outboard mounting plate;

at least one trim arm mounted between said propeller and said outboard mounting plate, said at least one trim arm being selectively extendable and retractable to adjust a trim angle of said propeller relative to said outboard mounting plate;

at least one depth arm having a first end pivotally mounted to said transom mounting plate and a second end pivotally mounted to said outboard mounting plate, said at least one depth arm being selectively extendable and retractable to adjust the depth of said outboard mounting plate;

at least one first support plate extending forwardly from said outboard mounting plate toward said transom mounting plate; and at least one second support plate extending rearwardly from said transom mounting plate toward said outboard mounting plate and pivotally connected to said outboard mounting plate.

* * * * *